United States Patent [19]

Goldsby et al.

[11] 4,129,251

[45] Dec. 12, 1978

[54] HEAT EXTRACTOR FOR STOVES

[76] Inventors: Claude W. Goldsby, P.O. Box 7646, Salem, Oreg. 97303; Roray J. Sandau, Rte. 1, Box 729, Salem, Oreg. 97304

[21] Appl. No.: 843,854

[22] Filed: Oct. 20, 1977

Related U.S. Application Data

[62] Division of Ser. No. 676,138, Apr. 12, 1976, Pat. No. 4,060,196.

[51] Int. Cl.[2] ..... F24B 7/00

[52] U.S. Cl. ..... 237/51; 126/121; 237/52

[58] Field of Search ..... 237/51, 55, 47, 50, 237/52; 126/120, 121, 123, 129, 130, 131, 135, 136, 164, 165, 163 R, 143, 242

[56] References Cited

U.S. PATENT DOCUMENTS

| | | | |
|---|---|---|---|
| 1,006,858 | 10/1911 | Lobach | 126/143 |
| 1,587,227 | 6/1926 | Hallberg | 126/121 |
| 2,359,197 | 9/1944 | Brooks | 126/121 |
| 2,375,318 | 5/1945 | Mudgett | 126/121 |
| 2,725,874 | 12/1955 | Payne | 126/121 |
| 2,819,711 | 1/1958 | Robinson | 126/242 |
| 2,863,443 | 12/1958 | Hoffman | 126/121 |
| 3,096,754 | 7/1963 | Howrey | 126/120 |
| 3,845,754 | 11/1974 | Wilkening | 126/121 |
| 3,896,785 | 7/1975 | Nelson | 126/129 |
| 3,970,067 | 7/1976 | Vaughn | 126/120 |
| 4,004,731 | 1/1977 | Zung | 237/51 |
| 4,010,728 | 3/1977 | Hempel et al. | 126/121 |
| 4,043,313 | 8/1977 | Sherman | 126/121 |
| 4,061,127 | 12/1977 | Fisher | 126/120 |
| 4,062,344 | 12/1977 | Mayes | 126/120 |

FOREIGN PATENT DOCUMENTS

| | | | |
|---|---|---|---|
| 961433 | 6/1964 | United Kingdom | 126/120 |

*Primary Examiner*—Henry C. Yuen
*Attorney, Agent, or Firm*—Francis Swanson

[57] ABSTRACT

A heat extractor for stoves or other type heaters is disclosed. The extractor is mounted in the firebox. The extractor takes air from the room and circulates it through a closed air path in the firebox where it is heated to a high temperature and returned to the room. Air from the extractor is also supplied to the combustion chamber in a controlled manner so that the rate of fuel burning is affected. Alternative methods of supplying and controlling air to the combustion chamber are disclosed.

3 Claims, 8 Drawing Figures

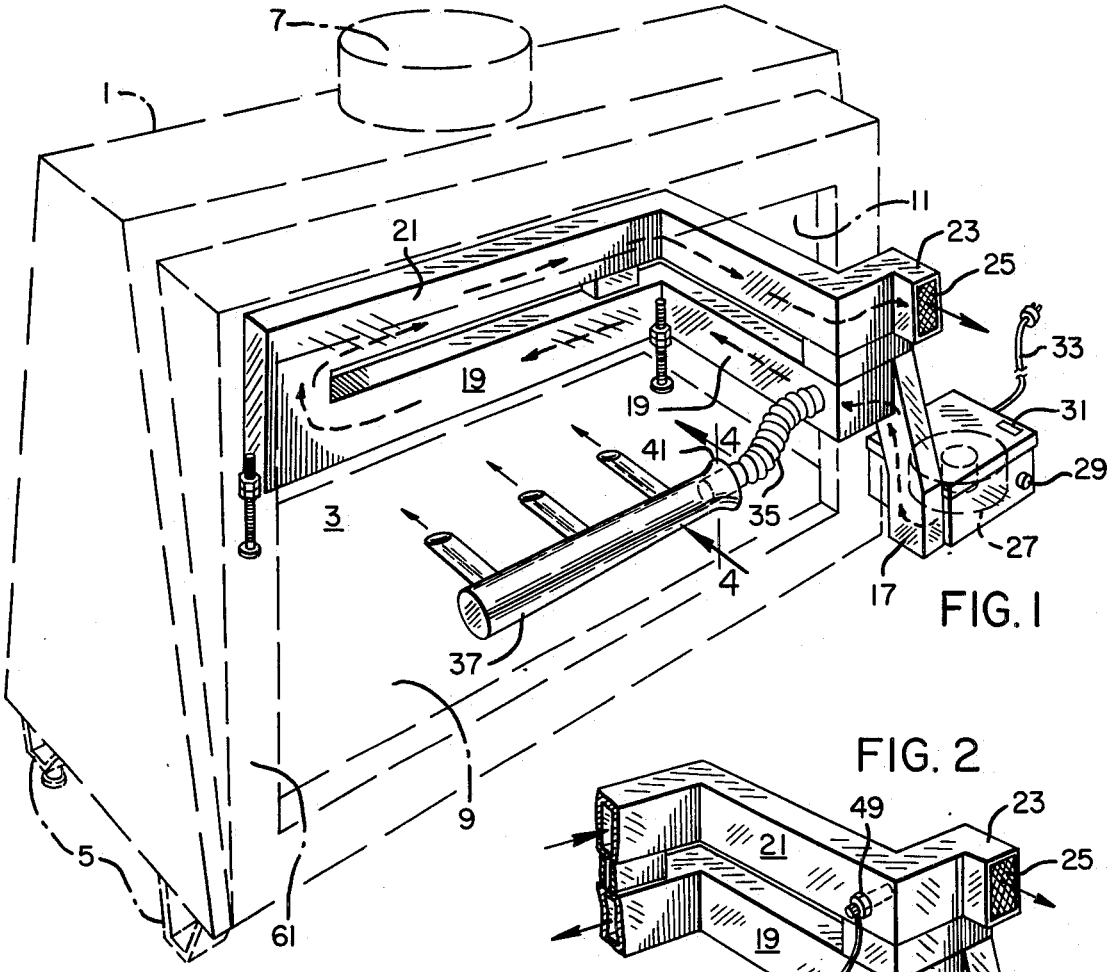
FIG. 1
FIG. 2
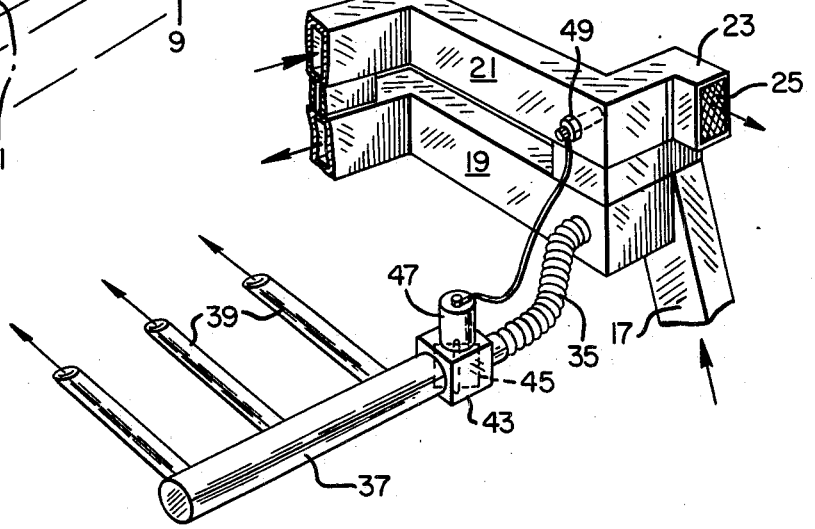
FIG. 4
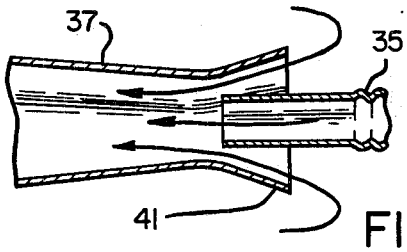
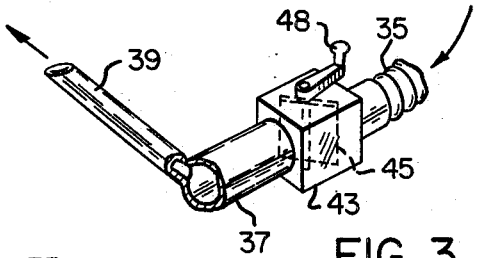
FIG. 3
FIG. 5
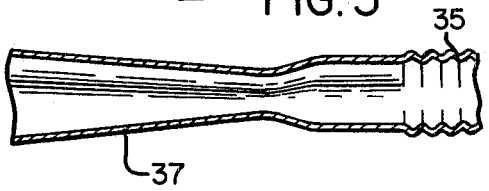

HEAT EXTRACTOR FOR STOVES

This is a division, of application Ser. No. 676,138 filed Apr. 12, 1976 now U.S. Pat. No. 4,060,196.

BACKGROUND OF THE INVENTION

1. Field of the Invention

The disclosed invention pertains to heat extractors in general and more particularly to those having controlled means of supplying air to the combustion chamber.

2. Description of the Prior Art

Numerous devices exist in the prior art for extracting heat from a firebox. All are aimed at recovering heat that would otherwise be lost by passage up the chimney.

Many consist of grate-like structures upon which material is burned and air is circulated by convection. Others run tubes through the coals and burning material and blow air through the tubes. Both such devices risk the danger of burn out with the result that noxious gases can escape into the room.

Still others are built after the manner of the circulating fireplace wherein an air path is constructed behind the brick lining of the fireplace and air is circulated therein, picking heat up from the warm bricks.

SUMMARY OF THE INVENTION

The invention is directed to improvements in recovering otherwise wasted heat from the combustion chamber of a stove or fireplace.

A principal object of the invention is to provide a means of circulating room air through a heat extractor which also supplies air to the combustion chamber in a controlled manner.

A further object of the invention is to provide a means of supplying air to the combustion chamber from a source outside the room in which the heater is located.

Throughout the following description the further objects and advantages of the invention will become apparent to those skilled in the art.

BRIEF DESCRIPTION OF THE DRAWINGS

FIG. 1 is a perspective view of the extractor showing it installed in a stove. The stove is shown in phantom.

FIG. 2 is a perspective view of a portion of the heat extractor showing an alternative construction of the means of controlling and supplying air to the combustion chamber.

FIG. 3 shows a manual device for controlling the combustion chamber air supply.

FIG. 4 is a sectional view taken along line 4 — 4 of FIG. 1.

FIG. 5 shows an alternative construction to that shown in FIG. 4.

DETAILED DESCRIPTION

Figure 6:
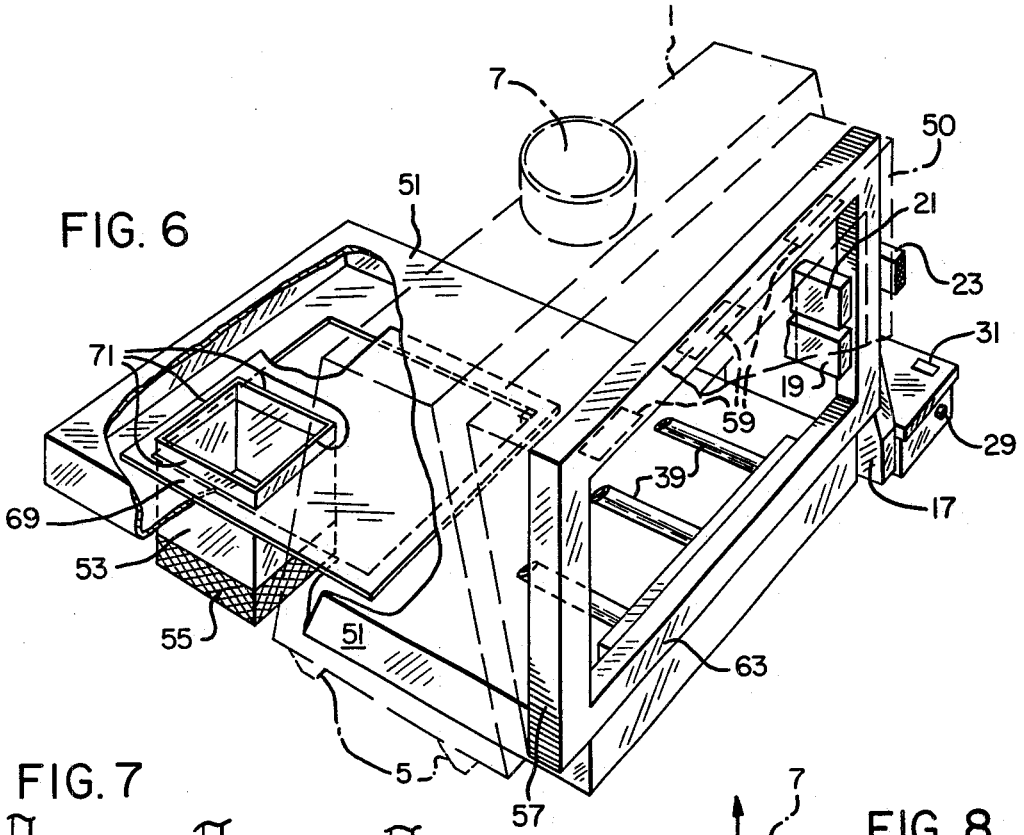
FIG. 6 shows a perspective view of an alternative construction for a combustion chamber air supply wherein the air is brought in from outside the room where the heater is located. The figure is partially broken away to more clearly reveal the details.

Referring now to the drawings, a stove is shown having a body 1. Within the body 1 is a combustion chamber 3. The stove rests on a plurality of legs 5 and has a pipe outlet 7 at the top of body 1. The combustion chamber 3 has a floor 9, sides 11, back wall 13 and top 15. The front or mouth of the combustion chamber defines an opening through which fuel is inserted into the stove. The opening is closed off by structural elements to be described later.

A heat extraction unit is contained within the combustion chamber 3. The extraction unit is comprised of an air intake manifold 17, a lower air passageway 19 and an upper air passageway 21 which terminates in an air exit port 23 which is covered by a screen 25. The extractor is so shaped that it lies against the sidewall 11 and back wall 13 of combustion chamber 3. Both manifold 17 and exit port 23 are located outside body 1 of the stove. The intake manifold is operatively connected to an air circulating fan 27. The fan 27 is equipped with a control switch 29, a thermostat 31 and is connected to a source of electrical power by cord 33.

A combustion chamber air supply tube 35 is connected to the lower air passageway 19. Tube 35 is preferably of flexible steel construction operatively connected to a manifold 37 which has a plurality of air ducts 39 branching therefrom.

In one construction the manifold 37 lies on the floor 9 and has a horn-like throat 41 into which protrudes tube 35. The diameter of manifold 37 increases with distance from throat 41, as shown in FIG. 1. However, tube 35 is not directly connected to throat 41 and air from within the combustion chamber may be drawn into manifold 37 as well as being blown in through tube 35. This construction is analagous to a jet pipe. FIG. 4 illustrates the arrangement of the parts.

In the construction shown in FIG. 5 the tube 35 is connected to manifold 37 to form a venturi.

In the construction of FIG. 2 tube 35 is connected to a housing 43 having a blade-like valve 45 contained therein. The valve 45 is positioned by automatic control 47 which is attached to air temperature sensor 49 located in upper air passageway 21. Manifold 37 is operatively connected to housing 43.

In FIG. 3 tube 35 is connected to housing 43 as is manifold 37. However, the valve 45 within the housing 43 is manually positioned by handle 48.

On the front of the combustion chamber 3 is mounted a set of glass doors 50 and spacers (not shown) which, when closed, seal off the opening of the combustion chamber from the room where the stove is located.

Figure 7:
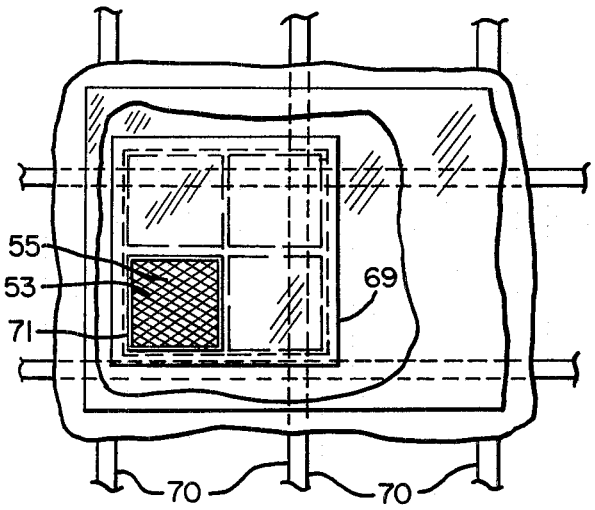
FIG. 7 is a plan view taken through section 7 — 7 of the air intake port shown in FIG. 8. The view is broken away to more clearly show the details.
Figure 8:
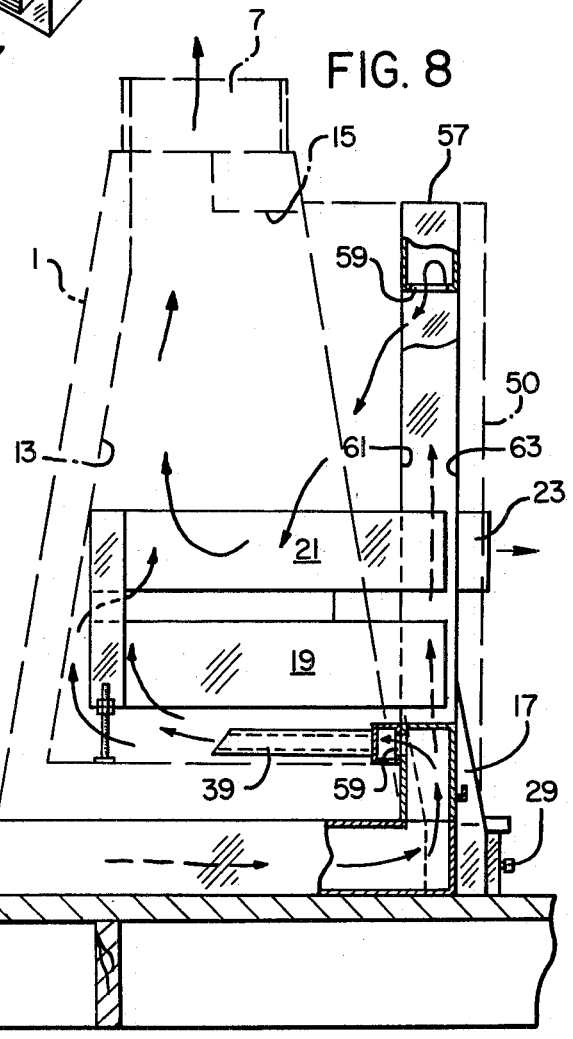
FIG. 8 is a side elevational view of the stove and the air supply system shown in FIG. 6. The heat extractor is also shown.
Figure 8:
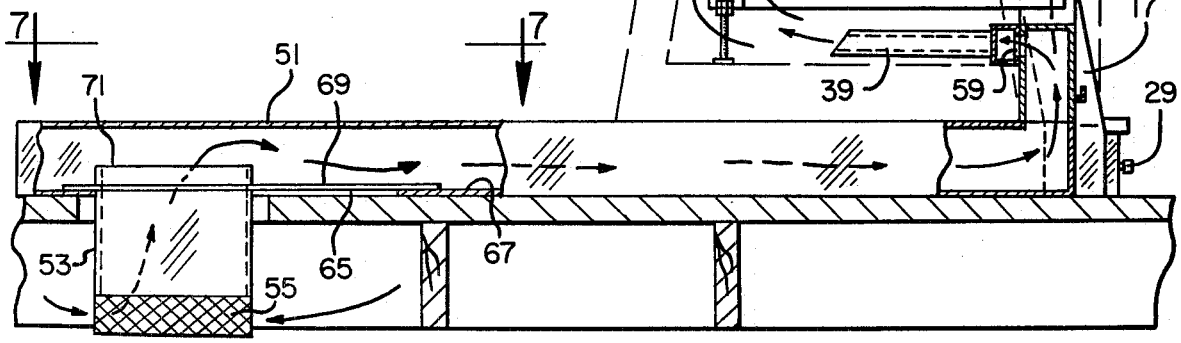

In an alternate construction as shown in FIGS. 6, 7 and 8 an external air supply duct is interposed between the opening of combustion chamber 3 and doors 50. The duct brings air from a source outside the room in which the stove is contained. The duct is comprised of a tubular conduit, shown as having a rectangular cross section 51, and having an air intake port 53 in one end. The mouth of port 53 is covered with screen 55. At its other end conduit 51 joins a rectangular manifold 57 containing a series of air exit ports 59. These air exit ports are located in several places on the inner periphery of the rectangular manifold 57. The inside surface 61 of manifold 57 mates with the opening of combustion chamber 3 and doors 49 mount to the outside surface 63 of manifold 57. Air ducts 39 may be optionally fitted to an air exit port 55 near the combustion chamber floor to direct air into fuel burning in chamber 3. Air conduit 51 has a large hole 65 cut in its underside 67. This hole is closed with a rectangular plate 69 upon which is mounted intake port 53. Because plate 69 is rectangular, it can be positioned so that intake port 53 will fall at several different locations to that it will miss an interfering floor joist 70 under the room containing the stove. An upwardly protruding lip surrounds the opening of air intake port 53 and defines a spark guard 71.

Operation

The operation of the invention is as follows. A fire is built within combustion chamber 3 and the doors 49 are closed, sealing the opening of chamber 3 from the room. Fan 27 is turned on with switch 29. Air is pulled into intake manifold 17 and forced through lower air passageway 19 where it picks up heat as it moves into upper air passageway 21 to be further heated before passing out into the room via air exit port 23. Depending on the volume of air circulated through passageways 19 and 21, air may be raised to temperatures as high as 500° or more.

As air is blown into passage 19 by fan 27 to be heated, some of it is forced into air supply tube 35 and is routed via manifold 37 and ducts 39 to the burning fuel.

In the construction as shown in FIGS. 1 and 4 air is blown from tube 35 into throat 41 and manifold 37 where the air is fed to the burning material via ducts 39. This action will draw air into manifold 37 from the combustion chamber 3. This combustion chamber air contains carbon monoxide which mixes with the fresh air from tube 35 and is chemically altered, thus materially reducing pollution in the flue gases.

In the construction of FIG. 5 the venturi configuration formed by joining tube 35 to manifold 37 as shown increases the air speed but lowers its pressure so that the air fed to the burning fuel does not materially disturb the hot ashes within combustion chamber 3. This arrangement of tube 35 and manifold 37 fo form a venturi makes up a forced draft which branches off air passage 19 and assures that an adequate supply of air will always be available within the chamber 3.

In the construction of FIG. 2 air entering manifold 37 is controlled by the position of butterfly valve 45 which is positioned from full open to completely closed by the automatic control 47. Control 47 senses the air temperature in upper passage 21 through sensor 49. Control 47 can be optionally set to shut off air to combustion chamber 3 at any required temperature. Thus, the air supply to the fire can be shut off and the fire will die down. This will result in cooler air in passage 21. The sensor 49 will detect the cooling and the automatic control 47 will open valve 45 to admit air. The fire will then burn more intensely. This will raise the air temperature in passage 21 until sensor 49 again determines that the air has reached the predetermined temperature. Control 47 will then respond and close off air via valve 45.

In the construction of FIG. 3 the valve 45 is manually positioned with handle 48 and must be repositioned if more or less air to the combustion chamber 3 is desired.

In the alternate construction shown in FIGS. 6, 7 and 8, the means for circulating room air and heating it is as described above through passages 19 and 21 except that air is supplied to the combustion chamber and burning fuel as follows. The natural draft of the stove draws outside air through intake port 53 into conduit 51. The conduit 51 lies on the floor of the room and passes under the body 1 of the stove. Intake port 53 protrudes through the floor to draw air from a source other than the room where the stove is located. Rectangular plate 69 which carries port 53 may be positioned in several orientations to avoid floor joists 70. Spark guard 71 surrounds the upper end of port 53 and prevents hot sparks from escaping out of the conduit 51.

The incoming air passes into manifold 57 and through multiple air exit ports 59 into combustion chamber 3. Ducts 39 direct the air into the burning fuel. This structure supplies air from a source outside the room which contains the stove.

Having described the preferred embodiment of our invention and its operation in detail, it will be apparent to those skilled in the art that many modifications could be made without departing from the true spirit and scope of the invention. We claim all such modifications as fall within the scope of the appended claims.

We claim:

1. In combination, a stove within a room having a floor supported by spaced-apart joists, the stove including a combustion chamber with an opening, an air intake manifold operatively connected to the combustion chamber, a combustion air supply duct which defines a hollow conduit having a top surface and an underside with an air intake opening therein, the conduit connected to a source of combustion air external to the room, wherein the improvement comprises:

an air intake port in the opening in the underside of the conduit, the port including a downwardly depending tubular mouth, the tubular mouth protruding downwardly through and below the underside of the conduit and through the room floor and upwardly through the underside of and within the conduit so that the upward projection of the mouth defines a sparkguard lip within the conduit, the air intake port is mounted on a substantially rectangular plate adjacent one corner thereof, the plate operatively connected to the underside of the conduit, the plate movable relative to the conduit's underside so that said port can be positioned to avoid the support joists in the room floor.

2. In combination, a stove within a room having a floor supported by spaced-apart joists, the stove including a combustion chamber with an opening, an air intake manifold operatively connected to the combustion chamber, a combustion air supply duct which defines a hollow conduit having a top surface and an underside with an air intake opening therein, the conduit connected to a source of combustion air external to the room, wherein the improvement comprises:

a heat extractor within the combustion chamber of the stove, the extractor having a lower air intake passage and an upper air exit passage connected to the room and to air circulation means;

and a movable air intake port mounted on a plate which is adjustably positionable between the floor joists, the port including an upwardly projecting lip within the conduit and above the conduit's underside;

and a downwardly projecting mouth operatively connected to the port and below the underside of the conduit.

3. The improvement of claim 2 wherein the upwardly projecting lip is continuous about one end of the intake port within the conduit and forms a sparkguard.

* * * * *